US006769541B1

(12) United States Patent
Carriere

(10) Patent No.: US 6,769,541 B1
(45) Date of Patent: Aug. 3, 2004

(54) SELF-ADHESIVE HANGER DEVICE, ASSEMBLY OF SAME AND METHOD FOR MAKING SAME

(76) Inventor: Denis Carriere, 19 rue de la Liberte, 12100 Millau (FR)

( * ) Notice: Subject to any disclaimer, the term of this patent is extended or adjusted under 35 U.S.C. 154(b) by 130 days.

(21) Appl. No.: 10/110,107

(22) PCT Filed: Oct. 6, 2000

(86) PCT No.: PCT/FR00/02784

§ 371 (c)(1),
(2), (4) Date: Sep. 13, 2002

(87) PCT Pub. No.: WO01/24667

PCT Pub. Date: Apr. 12, 2001

(30) Foreign Application Priority Data

Oct. 7, 1999 (FR) ..... 99 12502

(51) Int. Cl.[7] ..... A44B 7/00

(52) U.S. Cl. ..... 206/348; 206/820; 248/205.3; 248/683

(58) Field of Search ..... 206/348, 460, 206/449, 806, 820, 831; 40/299.01, 630; 156/267, 268; 248/205.3, 220.21, 213.2, 300, 610, 683; 283/51, 81, 101; 428/40.1, 41.8, 42.1, 42.2, 43, 133, 138

(56) References Cited

U.S. PATENT DOCUMENTS

| | | | | |
|---|---|---|---|---|
| 4,832,301 A | | 5/1989 | Kimimoto et al. | |
| 4,863,128 A | * | 9/1989 | Good | 248/205.3 |
| 5,328,137 A | * | 7/1994 | Miller et al. | 248/205.3 |
| 5,782,495 A | | 7/1998 | Grosskopf et al. | |
| 5,890,688 A | * | 4/1999 | Riordan | 248/205.3 |
| 6,350,502 B1 | * | 2/2002 | Grosskopf et al. | 248/205.3 |
| 6,517,038 B1 | * | 2/2003 | Pomerantz | 248/205.3 |

FOREIGN PATENT DOCUMENTS

| | | |
|---|---|---|
| GB | 1 175 296 | 12/1969 |

* cited by examiner

*Primary Examiner*—Luan K. Bui
(74) *Attorney, Agent, or Firm*—Young & Thompson

(57) ABSTRACT

The invention concerns a self-adhesive hanger device comprising a self-adhesive portion formed with a first flexible synthetic film strip (1) and hanging means formed by a second flexible synthetic film strip (5) welded integral to the first strip (1) along a parting line (6), the second strip (5) forming at least a tab provided with a slot (10) adapted to form a loop for hanging an object (11).

16 Claims, 6 Drawing Sheets

SELF-ADHESIVE HANGER DEVICE, ASSEMBLY OF SAME AND METHOD FOR MAKING SAME

Figure 1A:
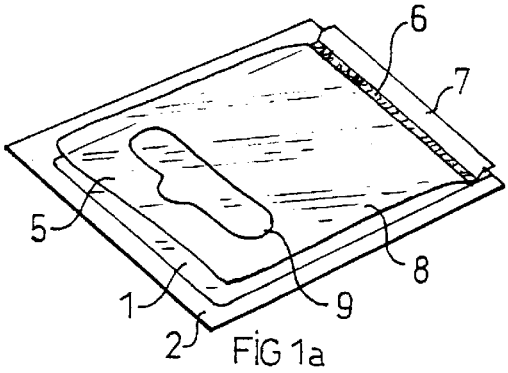

The invention relates to a self-adhesive hanger comprising a self-adhesive portion adapted to be able to be stuck to an object to be suspended, and a hanger secured to the self-adhesive portion and permitting hooking or gripping the hanger, and the object to which it is stuck.

There exist numerous situations in which objects must be able to be hung.

Such is particularly the case of packaged articles offered for sale in stores, hung from arms secured to shelves or presentation panels. For small articles, there is most often used specific packaging, so-called blisters, comprising a cardboard base (on which commercial information and/or instructions can be given) bearing a shell or a synthetic film enclosing the articles. The cardboard base is pierced to be able to be threaded on an arm. Similarly, certain other types of packaging provided with holes, permit hanging the articles. Nevertheless, it is known that it is important to be able to reduce the volume and quantity of material used in packages which, as trash, is costly and imposes increasing problems of elimination and pollution. Moreover, certain types of articles or packaging cannot be presented by hanging. Such is in particular the case of articles or groups of articles packaged in thermoshrunk film (magnetic cassettes, food pastes, cheeses, magazines, electrical connections or accessories, . . . ) or in paper or cardboard envelopes (packages of crackers, boxes of vegetables, cereals, cartons of cigarettes, candy, chocolate bars, paper articles, . . . ), or unpackaged materials (tools, receptacles (bottles, flasks, pots . . . ), lingerie, clothing, shoes, sporting goods, . . . ).

The same problem arises in numerous other situations, for example for hanging on the wall decorative objects such as frames, for the manual transportation of objects without handles (packages, shoes, documents, files, bottles, flasks . . . ).

Numerous solutions have been proposed to satisfy this problem in certain applications.

A first solution consists in a hook cut out of a so-called rigid synthetic material sheet (resilient in flexure, such as polyester, PVC, polypropane . . . ) stuck on a self-adhesive label adapted itself to be stuck on the object to be hung. This solution is relatively costly and complicated to make. Moreover, the presence of the rigid plate creates in general an added thickness preventing the production of reels of large dimension for automatic positioning with a standard label maker. Also, once positioned on an object for its presentation hung in a store, the rigid hook necessarily extends beyond the object, which poses problems of packaging, manipulation, size and risk of untimely hooking or tearing during storage or transport before hanging the articles. Moreover, this device is not very resistant to the extent to which a risk exists that the rigid plate comes unstuck from the label, or the label comes unstuck from the object, particularly under the influence of the weight of the hung object which is generally not exerted in the plane of the plate and of the label (this latter being only rarely centered relative to the object).

A second solution consists in a plate of rigid synthetic material of which a portion is cut out to form a hanger (hook or opening) and another portion is provided with a layer of self-adhesive material adapted to be stuck on an object to be hung. This solution also is relatively troublesome given the cost of the rigid synthetic materials and prevents use of an automatic labeler. Moreover, it cannot be used in a case in which the hanger must not extend beyond the contour of the object. And here again, it offers only a low strength and is not adapted for hanging heavy objects.

A third solution consists in a label of flexible synthetic material having a self-adhesive portion, and a pre-cutout portion suitable to form, by deployment and/or plastic stretching, a hanging handle.

In the case of deployment without stretching, it is possible to use low-cost flexible materials, such that this solution is thus less costly than the preceding. But the production of the cutout permitting forming the handle by deploying a strip of precut material is relatively delicate and costly to produce. Moreover, it offers a relatively low resistance to the extent to which the width of the strip forming the handle is necessarily very much less than that of the self-adhesive portion, and the ends or corners of the cutout constitute regions of less strength. Moreover, this label is less easy to use during the step of hanging objects, because it requires a precise manipulation to grip the pre-cutout strip and to deploy it to form the handle. Thus, if this manipulation can be suitable for special use, for example in a laboratory, it hinders productivity in industry or commerce during mass production. Moreover, the shape of the pre-cutout being essentially dictated by the size of the handle and its strength, it is difficult to produce various forms adapted to the hooking members. The handle thus formed accordingly does not generally offer a good holding of the object—particularly in horizontal directions, relative to the hooking member. And when the objects are grouped, the adjacent handles can become entangled. Finally, the handle thus deployed does not offer regularity of shape and is hardly pleasing to the eye. This solution is thus suitable for gripping handles for objects that are small in number and not very heavy, but is not suitable either for the presentation of articles at points of sale or for heavy articles.

Thus, U.S. Pat. No. 4,832,301 discloses a suspension label comprising a peripheral portion provided with double-faced adhesive strips for sticking it to an article, and a central cutout portion forming a suspension tab bendable along a bend line delimited by the ends of the cutout forming the tab, this bend line not corresponding to an assembly line. Rounded fillets must be provided at these ends of the cutout, which remain particularly fragile. In a modification, this label is not directly applied to the article, but to an intermediate adhesive label that is not cut out, and is itself stuck to the article, and which can be of paper to receive printing. This second label, provided to reinforce the hanging, is in practice without interest, because all the forces remain imparted to the first cutout label and the adhesive strips. Here again, the bend line is delimited by the cutout of the tab and does not correspond to an assembly line of the two labels. This device thus has all the drawbacks mentioned above, of difficulty and cost of production, fragility, aging, difficulty of handling, not very effective holding, not very good appearance.

U.S. Pat. No. 5,782,495 discloses another modification of a hanger of this third type in which the hanger portion is formed by an extension prolonging the adhesive portion, cut out and folded and bent down before use along a bend line in this adhesive region. Other portions are folded down on the assembly to hold the folded down hangar portion on the adhesive portion before use. As a result, the assembly is complex and costly and is adapted for special use in laboratories or care centers (for example for holding perfusion bags) but inappropriate for industrial or commercial use for hanging large numbers of articles.

In the case of deployment accompanied by plastic drawing, it is moreover necessary to use a stretchable material such as a polyamide, which is high priced. Moreover, the drawing operation is delicate and the risk is great of stretching the material too far. And the material in the stretched condition within the plastic region offers much less resistance in tension.

A fourth solution consists in a label formed by a flexible strip having two self-adhesive portions separated by an intermediate non-adhesive portion forming a hanging loop with the object itself when the self-adhesive portions are stuck to the object. Here again, such a label is in practice relatively costly to produce (because of the presence of two separate adhesive portions independently protected each by a non-stick protective sheet), cannot be applied to object to be hung by a conventional automatic labeler, and does not permit adapting the shape of the suspension loop to ensure good holding relative to the hooking members.

The invention seeks to overcome all of these drawbacks by providing a self-adhesive hanger which, simultaneously, can be produced at an extremely reduced cost, can be automatically applied in mass production with the help of a simple labeler, offers high strength and can be adapted to hanging very diverse objects, including heavy objects over a long period of time, and whose hanger can be easily adapted without increasing the cost, to hooking or gripping members with which it is adapted to coact.

The invention also seeks to provide a device which, moreover, will be easy to use, convenient and self-explanatory during hanging objects, and in particular, which will be compatible with constraints of productivity of the work of hanging large numbers of objects in series (stores or industrial depots, supermarkets . . . ).

To do this, the invention relates to a self-adhesive hanger comprising a self-adhesive portion adapted to be able to stuck to an object to be hung, formed by a first strip of a first film of flexible synthetic material of which one surface, the so-called adhesive surface, bears a layer of self-adhesive material and the other surface, the so-called outer surface, is free from adhesive material, and hanging means secured to the self-adhesive portion, formed by at least a second strip of a second sheet of flexible synthetic material, connected to and at least in part facing the external surface of the first strip, the second strip forming at least one tab comprising at least one cutout defining an opening in this tab adapted to form a hanging loop, this tab being adapted to be raised from the first strip by bending along a bend line, characterized in that:

- the second strip is connected in permanent assembly by welding to the external surface of the first strip, along at least one weld line,
- at least one tab extends over and at least in part facing the external surface of the first strip, from a weld line freely without being attached moreover to the first step, so as to be able to be raised from the first strip by bending along said weld line serving as a bend line.

Conventionally, in all the text, the term "self-adhesive" and its derivatives indicate a cold pressure sensitive adhesive.

The second strip is separate from the first strip (it does not constitute a prolongation of it), and is assembled permanently to the first strip in the sense that the two strips cannot normally be separated from each other under the influence of strong force and/or aging without undergoing deterioration. In particular, there are associated with each other without gluing, particularly without gluing with a self-adhesive material.

Preferably, and according to the invention, the second strip is superposed on the first strip and assembled with the first by hot welding without the addition of material, along at least one weld line. It is to be noted in particular that, contrary to gluing, an assembly by welding, particularly hot welding without the addition of material, does not cause any phenomenon of aging.

In a first modification of the invention, the second strip is welded to the first strip along a straight weld line from one end, extending along a straight end edge of the first strip, so as to define a tab forming a suspension loop which, before use, extends above the first strip, and, during use, is unfolded relative to the end weld line.

According to a second modification of the invention, the second strip is welded to the first strip by at least one straight weld line at least substantially medially and forms two tabs extending opposite each other relative to the weld line or lines, at least one of these tabs forming a hanging loop, the first strip extending from each side of the weld line or lines. In a first submodification, each of the two tabs of the second strip forms a hanging loop. In a second submodification, one of the tabs forms a hanging loop, whilst the other tab is free from a cutout and carries the mentioned printing. Moreover, preferably, and according to the invention, particularly in the first submodification, there are provided two straight weld lines at least substantially parallel and medially positioned one relative to the other, adjacent each other. Also as a modification, there can be provided a single straight weld line of a sufficiently great width.

It is to be noted that in the solutions of the prior art described above, in which a hanging member is assembled to an adhesive label, this hanging member is always provided in synthetic material of a rigid type. Thus, it can be considered that such a rigid material permits ensuring better resistance and better holding at the level of the hanging member which coacts with hooking means or gripping means and which is supposed to be subjected to the most force. Conversely, according to the invention, the hanging member formed by the second strip, although connected and assembled to the first strip, is of flexible material, which gives strong advantages and permits not only the ultimate positioning with the help of an automatic labeler and obtaining a low cost, but also equivalent strength and superior durability over time. Thus, the flexible tab forming the hanging loop can deform without stress, particularly under the influence of the weight of the suspended object, without generating stresses in the assembly of the strips between themselves nor on the welding of the device on the suspended object. Contrary to the cutout hanging tabs in the adhesive portions (U.S. Pat. No. 4,832,301) the hanging tab of a hanging device according to the invention is connected by a weld line serving as a bend line of high strength and not subject to untimely tearing.

The flexible synthetic materials and the rigid synthetic materials are of course well known. By way of flexible synthetic material, there can be used in a device according to the invention, any material sufficiently flexible to permit the positioning of the device on the object with a traditional label.

Preferably and according to the invention, the first strip and the second strip are formed of a same flexible synthetic material—particularly low density polyethylene—. In particular, it is possible to use standard low density polyethylene of low price, for example from recycling.

The first strip and the second strip can have at least substantially the same thickness, or on the contrary have very different thicknesses, according to the mechanical stresses which each strip must resist. Preferably, and according to the invention, they have a thickness comprised between 20 μm and 500 μm—particularly of the order of 30 μm to 150 μm—.

Moreover, preferably, and according to the invention, the first strip and the second strip have the same format and are superposed on each other. Preferably, and according to the invention, the first strip is carried by a removable non-stick support—particularly a siliconed paper—receiving the adhesive service of the hanging device in the manner of a label.

A device according to the invention can thus be produced and used as a simple self-stick label, and particularly several devices according to the invention can be grouped on a common support.

The invention also relates to a group of devices according to the invention carried by a same common non-stick support. Preferably, and according to the invention, such a group of devices is present in the form of a spool, and thus can be used as a spool of labels with a conventional label applicator for positioning the devices I series on the objects to be hung. As a modification, a group of devices according to the invention can be present on a sheet.

The invention also relates to a process for the production of a group of devices according to the invention. A process according to the invention is characterized in that:

- there is applied a first film of flexible synthetic material onto the non-stick support with the interposition of a layer of self-adhesive material, this first film having an external surface free from adhesive material,
- there is connected a second film of flexible synthetic material that is assembled rigidly in an unremovable manner by welding onto the external surface of the first film along at least one weld line,
- the hanging devices are then cut out by producing a halfway cutout passing through the thickness of the two films to delimit the contour of each hangar, and a halfway cutout passing through the thickness of the second film to produce cutouts defining the openings forming the hanging loops.

Preferably, and according to the invention, the different steps are continuously performed from spools of anti-stick support and films, to form at least one spool of hangars available like labels.

The invention also relates to a device, a group, and a process characterized in combination for all or a portion of the characteristics mentioned above and hereafter.

Figure 1B:
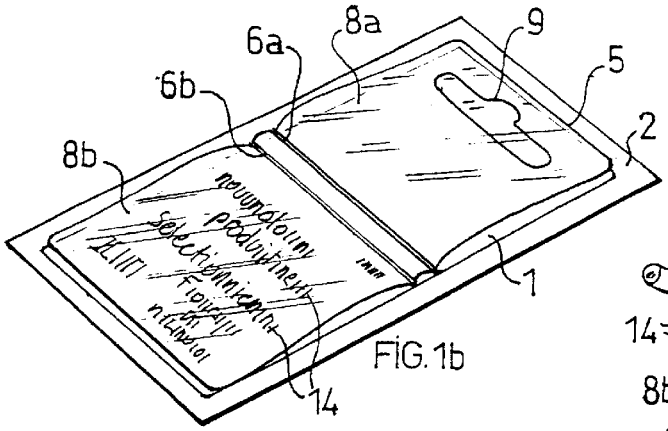
Figure 1C:
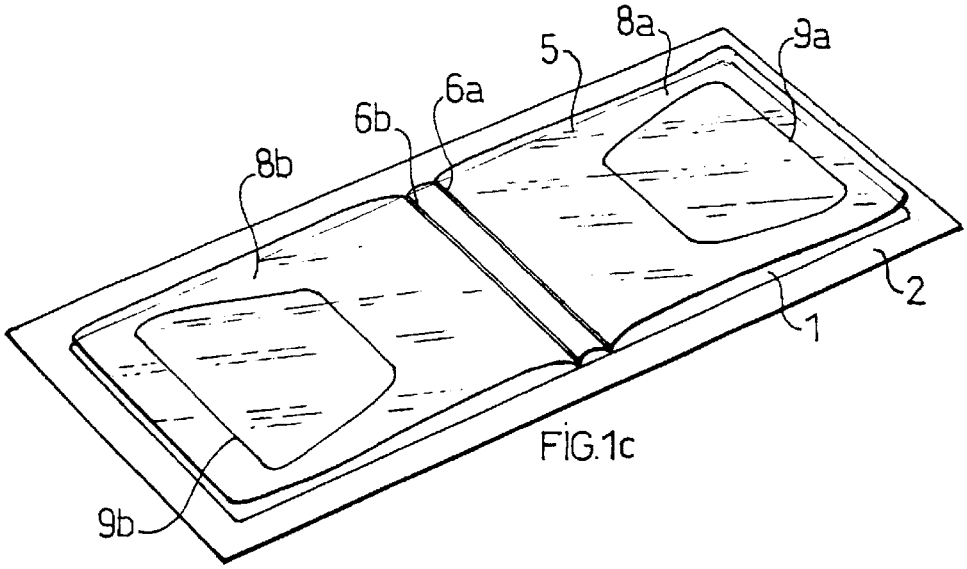

Other objects, characteristics and advantages of the invention will become apparent from a reading of the following description of several embodiments given solely in a non-limiting way, with reference to the accompanying drawings, in which:

FIGS. 1*a* to 1*c* are schematic perspective views showing three embodiments of a device according to the invention before use.

Figure 2A:
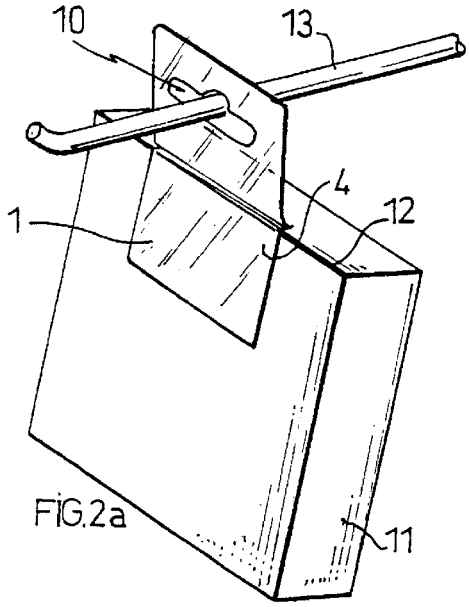
Figure 2B:
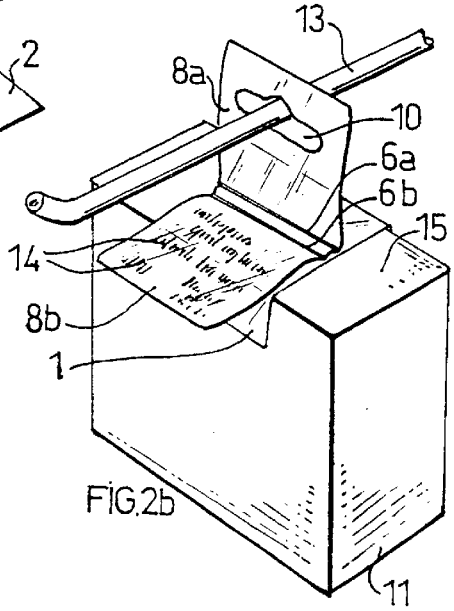
Figure 2C:
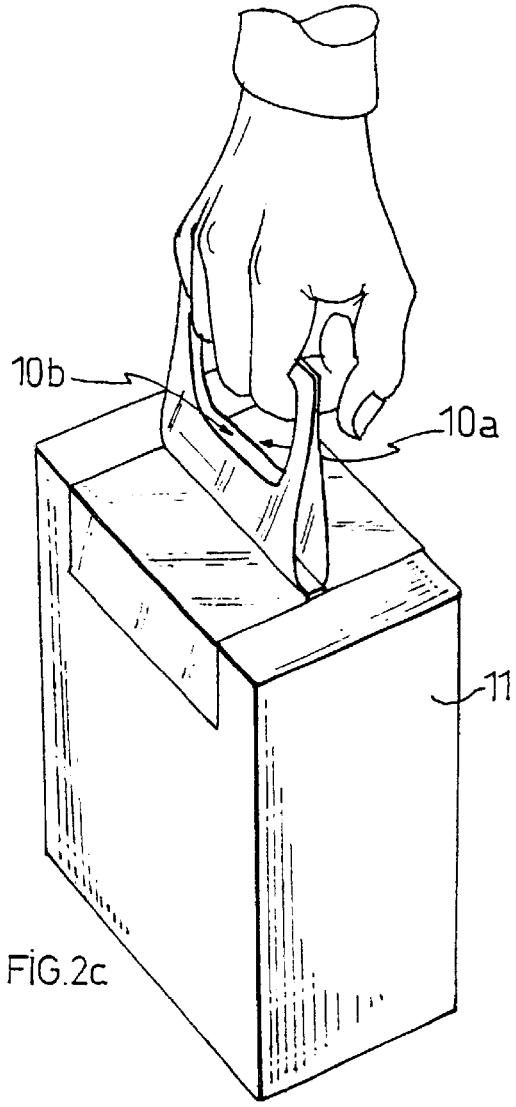
Figure 3:
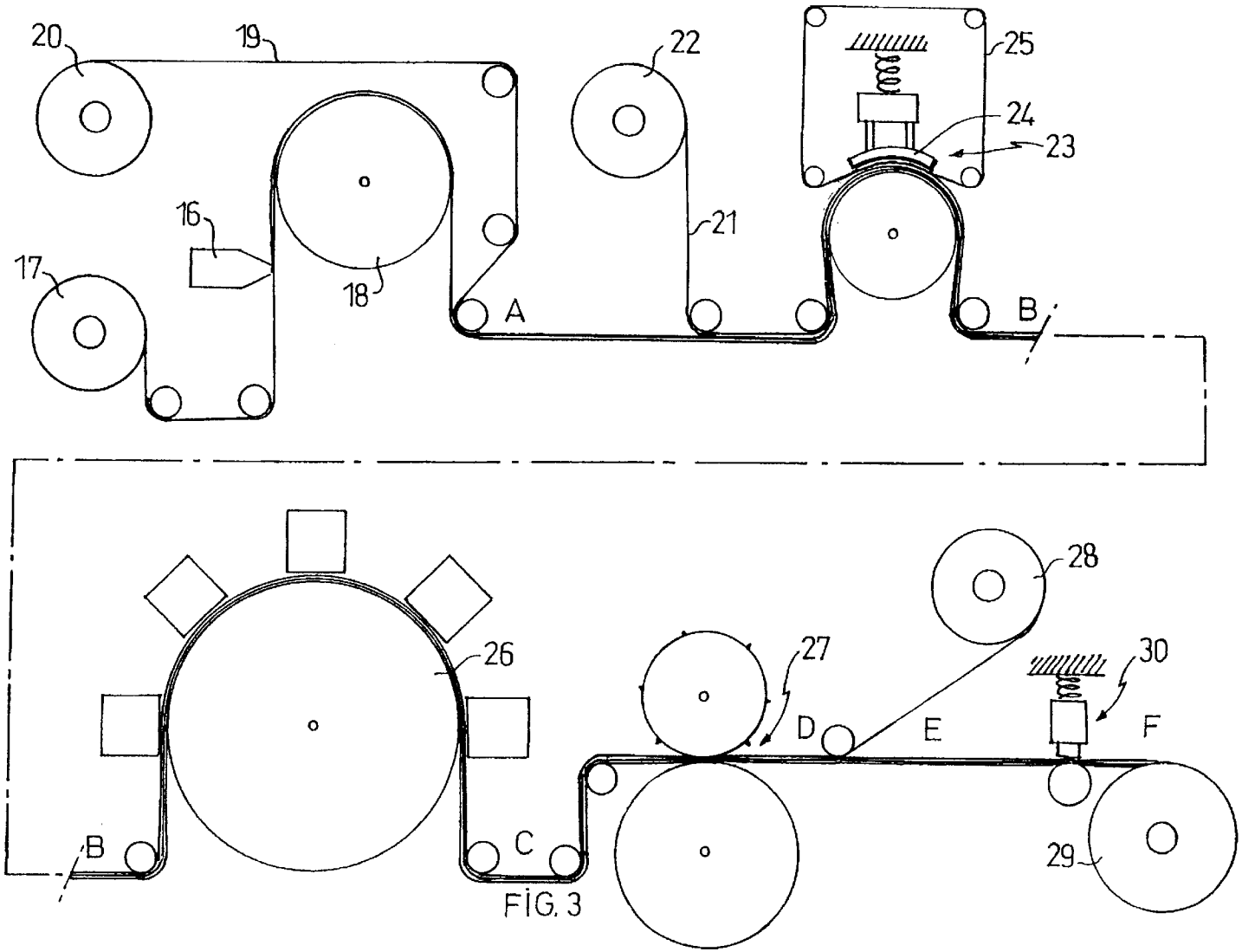
Figure 4A:
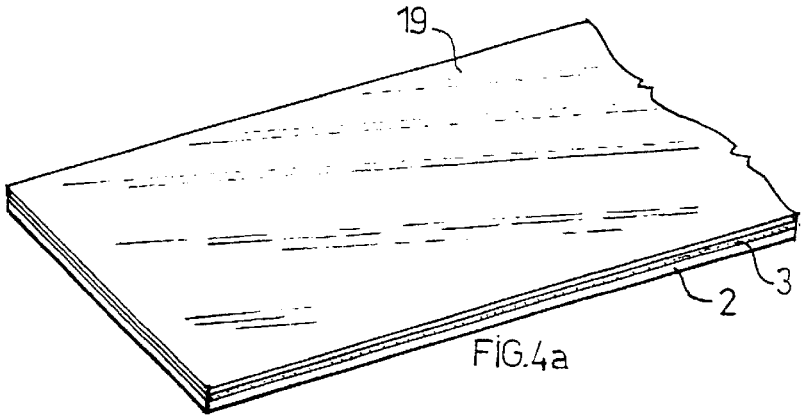
Figure 4B:
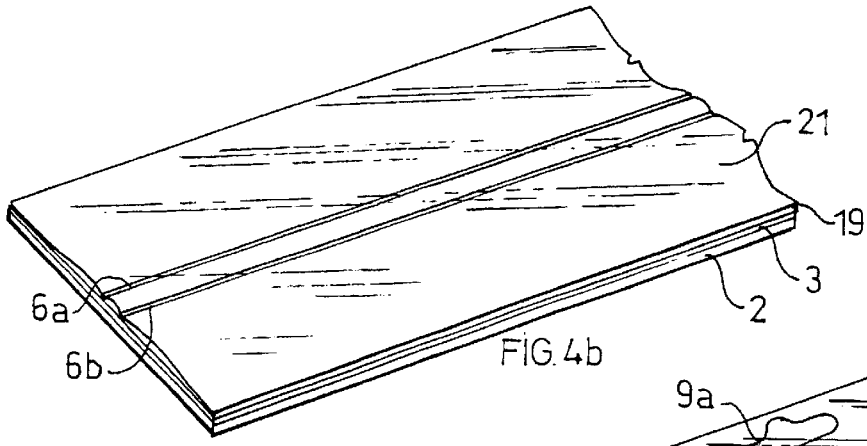
Figure 4C:
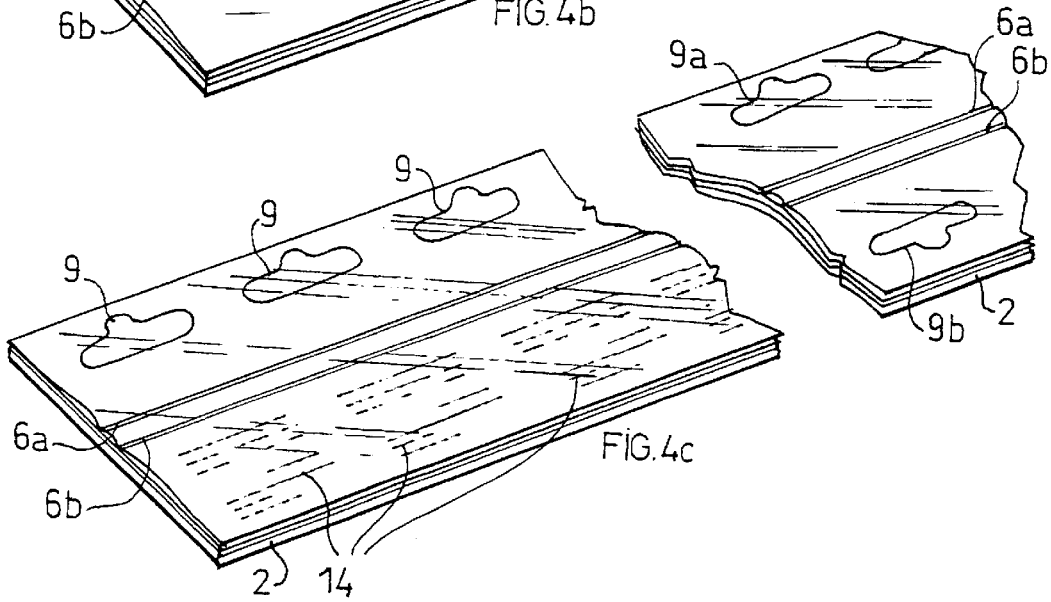
Figure 4D:
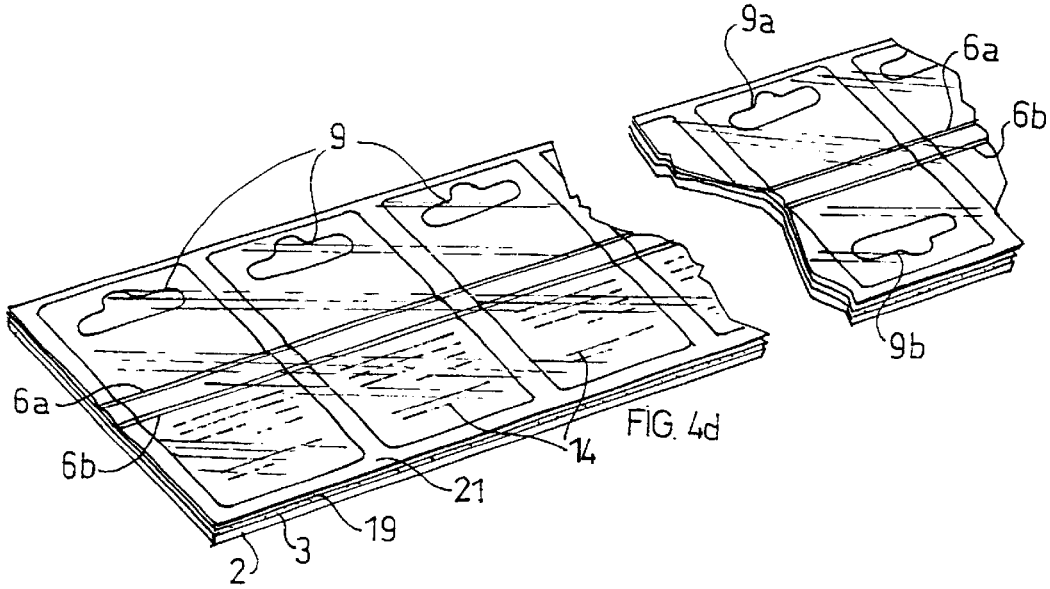
Figure 4E:
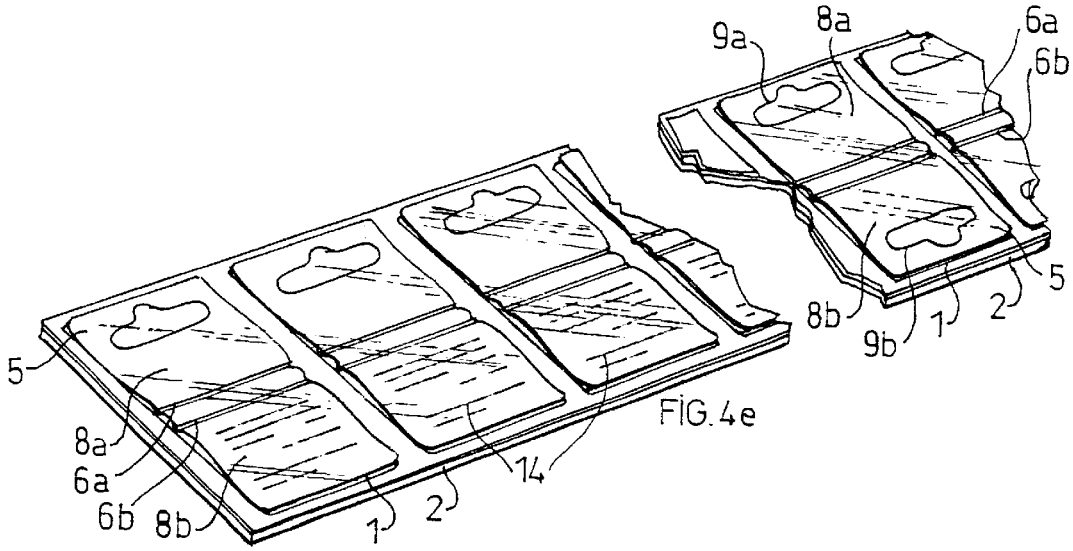
Figure 4F:
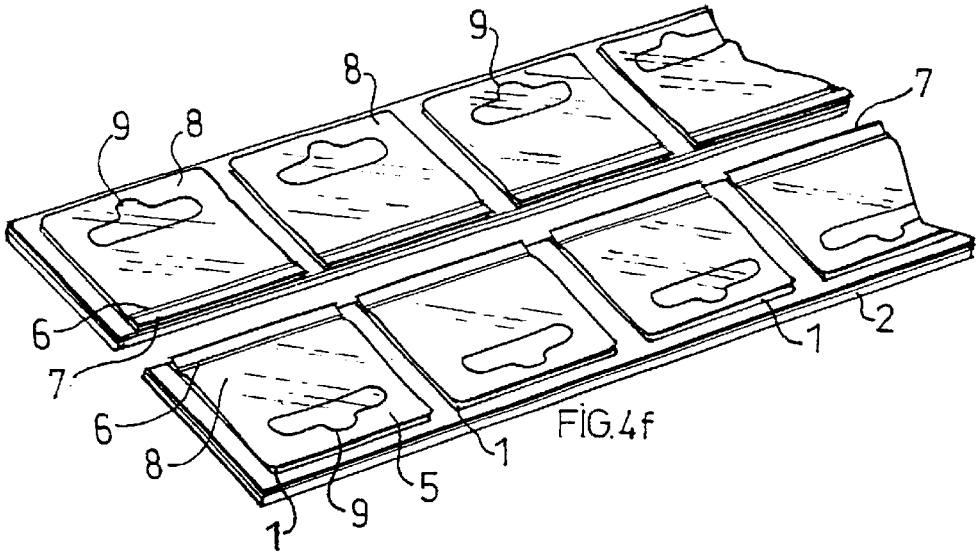
Figure 5:
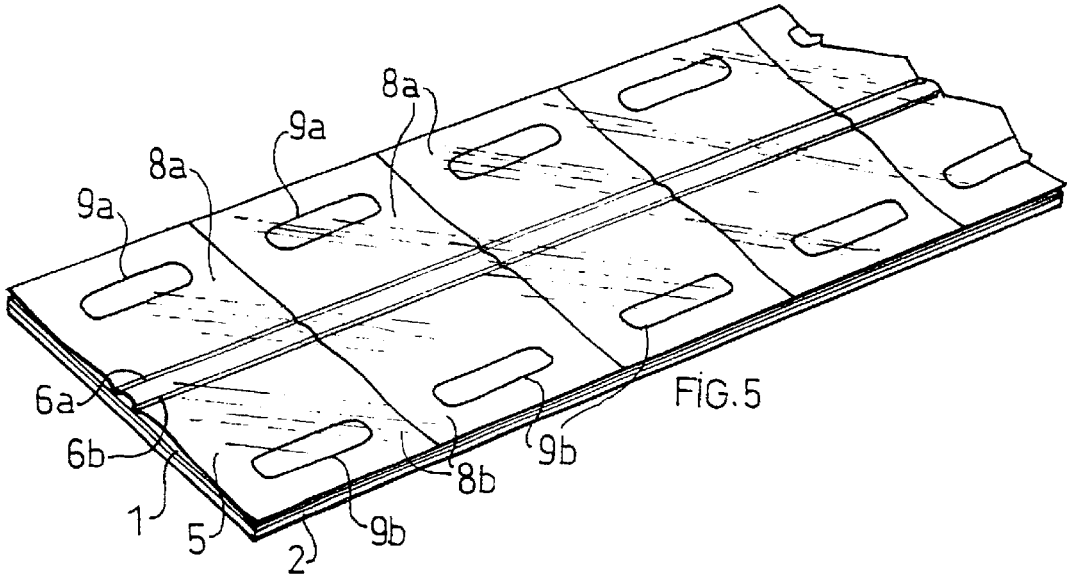

FIGS. 2*a* to 2*c* are schematic perspective views showing the three embodiments of FIGS. 1*a* to 1*c* in the course of use for hanging objects, FIG. 3 is a schematic diagram of an embodiment of a process according to the invention, FIGS. 4*a* to 4*f* are schematic perspective views showing a group of devices according to the invention at different stages A, B, C, D, E and F of the process of production of FIG. 3, FIG. 5 is a schematic perspective view of a modified embodiment of a group of devices according to the invention.

The device shown in FIG. 1*a* according to the invention comprises a first strip 1 of a first film of flexible synthetic material of which one adhesive surface carries a layer of adhesive material 3 covered by a non-stick support 2 which carries the hangar according to the invention. The other external surface 4 of the first strip 1 is free from adhesive material.

The first strip 1 is, in the example shown in FIG. 1, of a substantially rectangular shape. A second strip 5 of a second flexible synthetic film material is connected and assembled by welding along an end straight weld line 6 on the first strip 1. The weld line 6 extends immediately adjacent, parallel to and along one of the peripheral straight end edges 7 of the first strip 1. The weld line 6 forms a rigid assembly (without the possibility of relative movement except for bending about the weld line) the two films being inseparable.

The second strip 5 is at least substantially of the same format as the first strip 1, rectangular, and also forms a tab 8 extending freely from the weld line 6 without being attached moreover to the first strip 1 superposed on this first strip 1. This tab comprises a cutout 9 provided in the thickness of the second strip 5 and adapted to define an opening 10, such that the tab 8 itself forms a hanging loop. The tab 8 can be spaced and raised from the first strip 1 by bending of the second strip 5 along the weld line 6.

As is shown in FIG. 2*a*, to use this hangar, it suffices to separate the first strip 1 from its non-stick support 2 and to apply the adhesive surface of the first strip 1 to an object 11 to be hung. In the example shown in FIG. 2*a*, the weld line 6 and the end edge 7 along which the weld line 6 is provided, are disposed adjacent an end edge 12 of the object, such that the first strip 1 does not project beyond the contour of the object 11. So long as the device is not used, the second strip 5 remains superposed above the first strip 1, and the assembly of the hangar according to the invention thus remains at least substantially comprised within the volume of the object 11 without projecting outside it. To hang object 11 shown in FIG. 2*a*, it suffices to raise the tab 8 by bending it relative to the weld line 6 and engage the opening 10 (opening after removal of the internal portion of the film delimited by the cutout 9) in a hooking member 13 which, in the illustrated example, is formed by a simple rod such as is encountered in stores for the presentation of a series of articles for sale, suspended side by side with the others on the rod 13. Of course, the hooking member can take any of the possible forms and for example can be comprised by a double rod or tab or the like. The shape of the opening 10 provided in the tab 8 is suitable to that of the hooking member 13 to which the hangar is adapted. In the illustrated example, the opening 10 is a horizontal oblong opening provided with an upper medial notch permitting receiving the rod 13 and assuring certain holding relative to the horizontal direction perpendicular to the rod 13. As a modification (not shown), several openings such as the opening 10 can be provided, either when the hooking member 13 comprises several elements, or to be able to adapt to several shapes of hooking member 13.

In the second embodiment shown in FIGS. 1*b* and 2*b*, the second strip 5 is welded to the first strip 1 along two straight weld lines 6*a*, 6*b* provided in the medial portion of the second strip 5. These two weld lines 6*a*, 6*b* extend parallel to each other, adjacent one another along all the length of the second strip 5 and of the first strip 1 (which is to say between their longitudinal edges). The second strip 5 thus forms two tabs 8*a*, 8*b*, one on each side of the weld lines 6*a*, 6*b*. The first strip 8*a* is, as in the first embodiment of FIGS. 1*a* and 2*a*, provided with at least one cutout 9 forming an opening 10, such that this tab 8*a* forms a hanging loop. The second tab 8*b* is on the other hand free from any cutout or opening, and can be provided with printed material 14 such as technical and/or commercial information (manner of use, contents, price, discount coupons . . . ). As a modification (not shown), this second tab 8*b* could nevertheless be provided with a perforated line parallel to the weld line 6*b*, so as to be easily detachable (for example in the case in which it forms a discount coupon with different payout).

When the first tab 8*a* is raised by bending along the first weld line 6*a*, it extends at least substantially perpendicularly to and in the medial portion of the first strip 1. Thus, when this first strip 1 is stuck to the object 11 to be hung, as shown in FIG. 2*b*, the hanging tab 8*a* can be overall centered relative to the first strip 1 and relative to the object 11, such that the weight of the object 11 is exerted on the first strip 1, along the weld line 6*a* and on the second tab 8*a*, along a same vertical axis, without inclination of the object 11.

Conversely, in the first embodiment shown in FIG. 2*a*, the hanging device being applied to one side of the object 11, when this latter is hung, a certain inclination of the object 11 relative to the vertical takes place, the first adhesive strip 1 forming an angle separate from the flat angle with the tab 8. The flexibility of the tab 8 and of the weld line 6 do not prevent this inclination, so that the forces generated are small, as well as the risk of unsticking of the first strip 1 relative to the object 11.

However, in the second embodiment of FIG. 2*b*, this risk of unsticking is substantially nonexistent to the extent to which the first strip 1 can be sufficiently long to overlap an edge 15 of the object 11, with the two ends of the first strip 1 stuck onto the two opposite vertical surfaces of the object 11. This mounting is extremely resistant with time and permits in practice the suspension of heavy objects, with an excellent strength over time, even when the strips 1, 5 are formed of a standard flexible synthetic film of low cost such as low density polyethylene.

The third embodiment shown in FIGS. 1*c* and 2*c* is even stronger. It differs essentially from the preceding by the fact that the two tabs 8*a*, 8*b* are both provided with a cutout 9*a*, 9*b* defining an opening 10*a*, 10*b* (after removal of the portions of internal film delimited by the cutouts 9*a*, 9*b*), such that the two tabs 8*a*, 8*b* serve for the suspension of the object 11, as shown in FIG. 2*c*. The shape of the openings shown in this embodiment is of a type permitting providing a double handle that can be gripped by the hand of a user as shown in FIG. 2*c*. Thus, the device according to the invention is extremely simple, low cost and easy to apply to an object 11, to serve for manual carrying of objects without handles. Of course, as a modification, the openings 10*a*, 10*b* could also of course be similar to that of the two first embodiments, adapted to cooperate with a hooking member 13.

The device according to the invention can be made very economically, by use of a film of flexible material such as standard low density polyethylene, particularly from recycling. Preferably, the same flexible synthetic material, and more particularly the same film, can be used to form the two strips 1, 5. Moreover, these two strips preferably have at least substantially the same thickness, which can be comprised between 20 $\mu$m and 200 $\mu$m—particularly of the order of 30 $\mu$m to 110 $\mu$m—. For example, for relatively light objects, there can be used a film of 40 $\mu$m thickness, and for heavier objects a film of 100 $\mu$m thickness.

The shape of the different strips 1, 5 can be other than rectangular, for example elliptical or rounded and convex at the ends. The two superposed strips 1, 5 preferably have the same shape, so as not to generate any overthickness, which permits excessively stacking a large number of devices according to the invention, particularly the production of groups 29 of devices such as spools 29. For certain applications, nothing prevents the first and second strips 1 and 5 having slightly different shapes, either the first strip 1 being larger to ensure better sticking to the object 11, or the second strip 5 having larger dimensions to adapt to the hooking and/or gripping members, to improve the resistance of the device. In any event, the second strip 5, and particularly each tab 8, 8*a*, 8*b* of any form, extends, before use (before deployment by bending for the hanging of an article), at least in part facing the outer surface 4 of the first strip 1. The assembly thus is present in a compact and stable form, in the manner of a label, without being subject to deterioration during handling and is adapted to intensive use for mass production, particularly for positioning with the help of a labeler.

FIG. 2 shows a process for production according to the invention of a spool of hangers. This process is carried out continuously from a spool 17 of anti-stick support (siliconed paper) whose siliconed surface receives the self-adhesive material, which is for example a glue of the "hot melt" type, which is to say applied in melted condition, hot, at a glue application station 16, and then passed over a cooling roller 18, at the outlet of which it is assembled with a first film 19 from a spool 20, adapted to produce the first strip 1. The first film 19 is thus applied to the self-adhesive material, and there is obtained in step A of the process the assembly shown in FIG. 4*a* comprising the superposition of the non-stick support 2, a layer of self-adhesive material 3, and the first film 19, which is for example a film of low density polyethylene. A second film 21 is then superposed on the first film 19 and this second film 21 comes from a spool 22. The assembly then passes through a welding station 23 which is for example a hot welding station by application of hot irons 24 by means of an interposed protective strip unrolled continuously at 25 (for example a strip of teflon). At the outlet of the welding station 23, there is obtained, in step B, the assembly shown in FIG. 4*b*, the second film 21 being welded along two straight longitudinal weld lines 6*a*, 6*b* onto the first film 19. This assembly is then passed through a rotating finishing station 26 in which the halfway cutouts are produced in the second film 21 (and not in the first film 19) , to form the different cutouts 9 or 9*a*, 9*b* forming the openings 10 or 10*a*, 10*b* in the thickness of the second strip 5 of the devices. There is thus produced, as the case may be, in this finishing station 26, the different impressions of printed material on the external surface of the second film 21, such that there is obtained at the outlet, in step C, the assembly shown in FIG. 4*c*. In this figure, there is shown in fact two modified embodiments of which one corresponds to the second embodiment in which the second tab 8*b* is provided with printed material 14 (left portion of the figure), whilst the other has two tabs 8*a*, 8*b* provided with cutouts 9*a*, 9*b* forming openings 10*a*, 10*b*, so that both form hanging loops (right portion of the figure).

This complex in the form of a strip is then introduced into a transverse cutting station 27 in which there is carried out through the two films 19, 21 a cut so as to separate the hangers from each other. Several successive transverse cutout stations 27 can be provided, according to the shape of the hangers to be produced. There is thus obtained at the outlet, in step D, the complex shown in FIG. 4*d* similar to the preceding one, but in which the different transverse cutouts between the hangars have been carried out.

It is to be noted that the complex of FIG. 4*d* (step D) can be obtained, as a modification, in a single cutout step from the complex of FIG. 4*b* (step B), after if desired production of the printing, thanks to an engraved cutout cylinder having cutout members at different heights. This modification is applicable as well when the two strips 1, 5 are of the same form as when they are of different forms.

There is then carried out, if necessary, a trimming of the complex so as to remove the waste portions of the films 19 and 21. These waste portions are rolled up on a spool 28. The rest of the complex forms the group of hangers according to the invention shown in FIG. 4*e*, and obtained after trimming in step E. This group is rolled up on a spool 29, either directly to obtain the hangers with two tabs 8*a*, 8*b* and two weld lines 6*a*, 6*b*, or, as shown in FIG. 3, after a longitudinal cutout performed in a cutout station 30 in the case in which it is desired to obtain hangers according to the first embodiment with a single tab 8. In this longitudinal cutout station 30, the assembly of the complex, which is to say the two films 19, 21 and the non-stick support 2 are cut out, between the two weld lines 6*a*, 6*b*, such that there is obtained, for each hanger, a single straight end weld line 6 as described in relation to the first embodiment above. There are thus obtained two groups of hangers according to the invention as shown in FIG. 4*f*, in step F of the process, and these two groups are wound up separately on separate spools 29.

FIG. 5 shows a modified embodiment of the invention in which the different hangers are disposed continuously beside each other, and are of rectangular shape, such that no loss by trimming takes place. It is to be noted that there exist standard labelers permitting positioning such labels without trimming, on objects 11 in series. In this modification, there are also shown cutouts 9*a*, 9*b* forming openings 10*a*, 10*b* in the form of simple oblong openings.

Of course, other modifications of the invention can be provided. For example, if only the half of the first strip 1 is adhesive in the second or third embodiment, there is obtained a device comprising three tabs which either all serve for hanging, or, on the contrary, serve to carry printed material. Other modifications are also possible according to the applications.

In practice, such hangers can be obtained at an extremely low cost, typically of the order of 5 to 20 times less than previously known devices.

Moreover, the suspension device according to the invention is extremely efficient in terms of resistance and strength over time.

In particular, it is always possible to select thickness of films and/or surfaces of the self-adhesive portion or portions permitting the hanging of a predetermined object according to its weight and the required duration of hanging.

What is claimed is:

1. Self-adhesive hanger comprising a self-adhesive portion (1) adapted to be stuck to an object (11) to be hung, formed by a first strip (1) of a first flexible synthetic film material of which one surface, the so-called adhesive surface, carries a layer of self-adhesive material (3) and the other surface, the so-called outer surface (4), is free from adhesive material, and hanger means (5, 10) secured to the self-adhesive portion (1), formed by at least one second strip (5) of a film of flexible synthetic material, connected at least in part facing the external surface (4) of the first strip (1), the second strip (5) forming at least one tab (8, 8*a*, 8*b*) comprising at least one cutout (9, 9*a*, 9*b*) defining an opening (10, 10*a*, 10*b*) in this tab (8, 8*a*, 8*b*) suitable to form a suspension loop, this tab (8, 8*a*, 8*b*) being adapted to be raised from the first strip (10) by bending about a bend line, characterized in that:

the second strip (5) is connectedly assembled permanently by welding onto the external surface (4) of the first strip (1), along at least one weld line (6, 6*a*, 6*b*), at least one tab (8, 8*a*, 8*b*) extends over and at least in part facing the external surface (4) of the first strip (1), from a weld line (6, 6*a*, 6*b*) freely without being attached moreover to the first strip (1), so as to be able to be raised from the first strip (1) by bending about said weld line (6, 6*a*, 6*b*) serving as a bend line.

2. Device according to claim 1, characterized in that the second strip (5) is superposed on the first strip (1) and assembled to the first strip by hot welding without addition of material along at least one weld line (6, 6*a*, 6*b*).

3. Device according to claim 2, characterized in that the second strip (5) is welded to the first strip (1) by a weld line (6) having a straight end extending along a straight end edge (7) of the first strip (1), so as to define a tab (8) forming a suspension with which, before use, extends above the first strip (1), and, during use, is folded relative to the weld line end (6).

4. Device according to claim 2, characterized in that the second strip (5) is welded to the first strip by means of a straight weld line (6*a*, 6*b*) at least substantially medially disposed and forms two tabs (8*a*, 8*b*) extending opposite each other relative to the weld line or lines (6*a*, 6*b*), at least one of said tongues forming a hanger loop, the first strip (1) extending on each side of the weld line or lines (6*a*, 6*b*).

5. Device according to claim 4, characterized in that each of the two tabs (8*a*, 8*b*) of the second strip (5) forms a hanger.

6. Device according to claim 4, characterized in that one (8*a*) of the tabs forms a hanger loop, whilst the other tab (8*b*) is free from a cutout and carries printed material (14).

7. Device according to claim 4, characterized in that it comprises two straight weld lines (6*a*, 6*b*) at least substantially medially disposed and parallel to each other, adjacent each other.

8. Device according to claim 1, characterized in that the first strip (1) and the second strip (5) are formed of the same flexible synthetic material.

9. Device according to claim 8, characterized in that the flexible synthetic material is low density polyethylene.

10. Device according to claim 1, characterized in that the first strip (1) and the second strip (5) have a thickness comprised between 20 $\mu$m and 500 $\mu$m—particularly of the order of 30 $\mu$m to 150 $\mu$m—.

11. Device according to claim 1, characterized in that the first strip (1) and the second strip (5) have the same format and are superposed on each other.

12. Device according to claim 1, characterized in that the first strip (1) is carried by a removable non-stick support (2) particularly a siliconed paper receiving the adhesive surface of the hanger in the manner of a label.

13. Group of hangers according to claim 1, carried by a common non-stick support (2).

14. Group of hangers according to claim 13, characterized in that they are on a spool (16).

15. Process for the production of a group of hangers according to claim 13, characterized by the fact that:

there is applied a first film (19) of flexible synthetic material onto a non-stick support (2) with the interposition of a layer of self-adhesive material (3), this first film (19) having an external surface free from adhesive material, a second film (21) of flexible synthetic material is rigidly assembled permanently by welding on the external surface of the first film (19) along at least one weld line (6, 6*a*, 6*b*), then the hangers are cut out by providing a halfway cutout passing through the thickness of the two strips (19, 21)

to delimit the contour of each hanger, and a halfway cutout passing through the thickness of the second film (21) is produced to make cutouts (9, 9*a*, 9*b*) defining openings (10, 10*a*, 10*b*) forming suspension loops.

16. Process for the production of a group of hangers according to claim 15, characterized in that the different steps are carried out continuously from spools (17) of non-stick support (2) and (20, 22) of films (19, 21), to produce at least one spool (29) of hangers available like labels.

* * * * *